US009551085B2

(12) United States Patent
Liao

(10) Patent No.: US 9,551,085 B2
(45) Date of Patent: Jan. 24, 2017

(54) ELECTROCHEMICAL POLISHING SOLUTION, PROCESS FOR ELECTROCHEMICALLY POLISHING GRAPHITE GATE ELECTRODE AND GRAPHITE GATE ELECTRODE

(71) Applicants: BOE TECHNOLOGY GROUP CO., LTD., Beijing (CN); Beijing BOE Vacuum Technology Co., Ltd., Beijing (CN)

(72) Inventor: Meiling Liao, Beijing (CN)

(73) Assignees: BOE TECHNOLOGY GROUP CO., LTD., Beijing (CN); Beijing BOE Vacuum Technology Co., Ltd., Beijing (CN)

( * ) Notice: Subject to any disclaimer, the term of this patent is extended or adjusted under 35 U.S.C. 154(b) by 208 days.

(21) Appl. No.: 14/316,302

(22) Filed: Jun. 26, 2014

(65) Prior Publication Data

US 2015/0247255 A1 Sep. 3, 2015

(30) Foreign Application Priority Data

Feb. 28, 2014 (CN) ..... 2014 1 0073381

(51) Int. Cl.

| | |
|---|---|
| ***C25F 3/16*** | (2006.01) |
| ***C25F 3/30*** | (2006.01) |
| ***H01J 19/38*** | (2006.01) |
| *H01J 9/14* | (2006.01) |

(52) U.S. Cl.

CPC . *C25F 3/16* (2013.01); *C25F 3/30* (2013.01); *H01J 19/38* (2013.01); *H01J 9/14* (2013.01)

(58) Field of Classification Search

CPC ..... C25F 3/00

See application file for complete search history.

(56) References Cited

U.S. PATENT DOCUMENTS

| | | | | |
|---|---|---|---|---|
| 2,494,425 A * | 1/1950 | Bakker | ..... | C25F 3/16 204/294 |
| 4,269,677 A * | 5/1981 | Blomsterberg | ..... | C25F 3/06 204/DIG. 9 |
| 2003/0178320 A1* | 9/2003 | Liu | ..... | B23H 3/08 205/640 |

(Continued)

FOREIGN PATENT DOCUMENTS

| | | |
|---|---|---|
| CN | 102453444 A | 5/2012 |
| CN | 103122475 A | 5/2013 |
| CN | 103228822 A | 7/2013 |

OTHER PUBLICATIONS

First Office Action for Corresponding CN Application No. 20140073381.6, dated Jul. 31, 2015, 5 pages.

*Primary Examiner* — Nicholas A Smith

(74) *Attorney, Agent, or Firm* — Kinney & Lange, P.A.

(57) ABSTRACT

The invention discloses an electrochemical polishing solution, a process for electrochemically polishing a graphite gate electrode and a graphite gate electrode, which are used for providing an electrochemical polishing solution and a polishing process to efficiently remove the contaminant on the surface of a gate electrode and improve the quality of the gate electrode. Said electrochemical polishing solution comprises 900-1000 parts by weight of water; 195-205 parts by weight of an alkaline metal hydroxide; 49-51 parts by weight of a weak acid salt; and 294-306 parts by weight of an additive.

9 Claims, 1 Drawing Sheet

(56) References Cited

U.S. PATENT DOCUMENTS

2005/0145508 A1* 7/2005 Larsen ..... A61L 31/022
205/684
2008/0067077 A1 3/2008 Kodera et al.

* cited by examiner

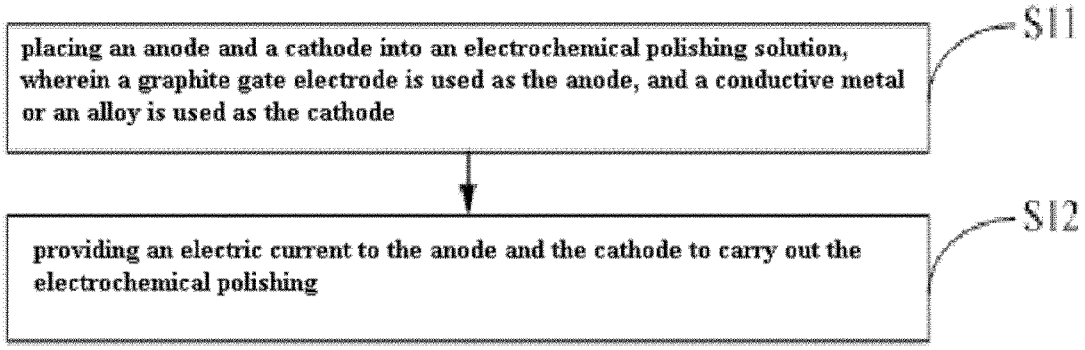
placing an anode and a cathode into an electrochemical polishing solution, wherein a graphite gate electrode is used as the anode, and a conductive metal or an alloy is used as the cathode
S11
providing an electric current to the anode and the cathode to carry out the electrochemical polishing
S12

ELECTROCHEMICAL POLISHING SOLUTION, PROCESS FOR ELECTROCHEMICALLY POLISHING GRAPHITE GATE ELECTRODE AND GRAPHITE GATE ELECTRODE

FIELD OF THE INVENTION

The invention relates to the technical field of the electrochemical treatment for a nonmetallic surface, in particular, to an electrochemical polishing solution, a process for electrochemically polishing a gate electrode and a graphite gate electrode.

BACKGROUND OF THE INVENTION

In the technical field of electrovacuum, the pyrolytic graphite gate electrode is the most ideal material for the gate electrode of large-scale emission tube, in particular, the high-power emission triode/tetrode relating to the anode cooled by a hyper vapotron. By producing the gate electrode from pyrolytic graphite, the deformation of the gate electrode, which can be induced by the mechanical stress caused by the butt-welding, welding of the gate electrode cap, matching of the support or the like, is completely eliminated. At the same time, this gate electrode has good thermal properties, mechanical properties, conductivity, and vacuum properties.

However, in the production process of the pyrolytic graphite gate electrode, paraffin wax, dusts and other impurities exist on the surface of the gate electrode. During the gas exhausting process of the electron tube, these substances are decomposed due to the heating of the electrode, and release a large amount of gas. Or, in later application, these substances are gradually decomposed or evaporated, which makes the vacuum degree in the tube worse. The high-voltage-withstanding ability of the electron tube is seriously affected, and even the electron tube becomes a waste product.

Therefore, before the graphite gate electrode is fixed into a tube, it must be subjected to a cleaning treatment. Without the cleaning treatment, the graphite gate electrode in exhausting stage will release gas from the gate electrode, so that the vacuum degree cannot be increased, or the current at the burrs on the gate electrode is too large, and thus a waste product is produced.

In prior art, the surface treating process for a graphite gate electrode comprises the steps of immersing the graphite gate electrode into gasoline for 12 h, washing the graphite gate electrode with tap water to clean it, then boiling it with deionized water for 30 min, thereafter, cleaning it with ultrasonic treatment for 1 h. Thus, the process of the cleaning treatment for the surface of the graphite gate electrode is achieved. The gasoline can only serve for de-oiling, but not for removing the dusts and burrs on the surface of the graphite gate electrode.

Additionally, in prior art, the surface treating process for the graphite gate electrode has a relatively long duration, relatively low de-oiling rate (that is, cannot completely remove the gasoline). Additionally, gasoline is inflammable and is not safe during the application.

SUMMARY OF THE INVENTION

The invention provides an electrochemical polishing solution, a process for electrochemically polishing a graphite gate electrode, and a graphite gate electrode, in order to provide an electrochemical polishing solution having a shorter cleaning period and stronger detergency. A graphite gate electrode electrochemically polished with this electrochemical polishing solution has a cleaner surface, and can improve the high-voltage-withstanding ability of the gate electrode.

Said electrochemical polishing solution comprises:

900-1000 parts by weight of water;

195-205 parts by weight of an alkaline metal hydroxide;

49-51 parts by weight of a weak acid salt; and 294-306 parts by weight of an additive.

Preferably, the parts by weight of said alkaline metal hydroxide are 200 parts by weight, the parts by weight of said weak acid salt are 50 parts by weight, and the parts by weight of said additive are 300 parts by weight.

Preferably, said alkaline metal hydroxide is sodium hydroxide or potassium hydroxide; said weak acid salt is potassium hydrogen fluoride or potassium chromate; and said additive is glycerin.

The invention provides a process for electrochemically polishing a graphite gate electrode, comprising the steps of:

placing an anode and a cathode into an electrochemical polishing solution and providing an electric current to the anode and the cathode to carry out the electrochemical polishing, wherein a graphite gate electrode is used as the anode, and a conductive metal or an alloy electrode is used as the cathode, and the electrochemical polishing solution is any one of the above-mentioned electrochemical polishing solutions.

Preferably, providing the electric current to the anode and cathode to carry out the electrochemical polishing comprises providing an electric current of 160±5 ampere to the anode and cathode, wherein the duration of providing the electric current is 3-5 min and the temperature of the electrochemical polishing solution during the polishing is 90±5° C.

Preferably, said process further comprises the steps of:

washing the electrochemically polished graphite gate electrode with water;

cleaning the graphite gate electrode washed with water in an ultrasonic cleaning device for 50-60 min; and subjecting the graphite gate electrode cleaned by the ultrasonic cleaning device to dewatering treatment.

Preferably, subjecting the graphite gate electrode to dewatering treatment comprises cleaning the graphite gate electrode cleaned by the ultrasonic cleaning device with an alcohol.

Preferably, subjecting the graphite gate electrode to dewatering treatment further comprises blow-drying the graphite gate electrode cleaned with an alcohol by high pressure air or a hair drier.

The invention further provides a graphite gate electrode produced by any one of the above-mentioned processes.

To sum up, the electrochemical polishing solution of the invention comprises 900-1000 parts by weight of water; 195-205 parts by weight of an alkaline metal hydroxide; 49-51 parts by weight of a weak acid salt; and 294-306 parts by weight of an additive. The electrochemical polishing solution can eliminate dusts and burrs on the surface of a graphite gate electrode, and thus avoid the generation of a waste product caused by the larger current due to the burrs on the gate electrode. The graphite gate electrode obtained by the electrochemical polishing process of the invention has a clean surface, can prevent the gate electrode from releasing gas, improves the high-voltage-withstanding ability of the gate electrode, and furthermore, has a shorter treatment period, is nonflammable and safer.

BRIEF DESCRIPTION OF THE DRAWINGS

FIG. 1 is a schematic flow chart of the process for electrochemically polishing a graphite gate electrode according to the invention.

DETAILED DESCRIPTION OF THE INVENTION

The invention provides an electrochemical polishing solution, a process for electrochemically polishing a graphite gate electrode and a graphite gate electrode, in order to provide an electrochemical polishing solution having a shorter cleaning period and stronger detergency. A graphite gate electrode electrochemically polished with this electrochemical polishing solution has a clean surface, and can improve the high-voltage-withstanding ability of the gate electrode.

Electrochemical polishing is also referred to as electrolytic polishing. The electrolytic polishing comprises the steps of immersing an anode and a cathode into an electrolytic cell and providing DC to them, so as to result in selective dissolution of the anode, and thus achieving the effect of improving shine of the surface of the workpiece, wherein the workpiece to be polished is used as the anode, and a conductive metal or an alloy electrode is used as the cathode. The metal is selectively dissolved in the electrolyte solution (wherein the concave parts come into a passive state while the convex parts are actively dissolved) by controlling the current density, the viscosity of the solution and the temperature, so as to achieve the purpose of electrochemical leveling and polishing.

Firstly, the electrochemical polishing solution provided by the invention is described.

The electrochemical polishing solution provided by the invention comprises water, an alkaline metal hydroxide, a weak acid salt, and an additive playing a role of anodic protection. In other words, said electrochemical polishing solution comprises following components of:

900-1000 parts by weight of water;

195-205 parts by weight of an alkaline metal hydroxide;

49-51 parts by weight of a weak acid salt; and 294-306 parts by weight of an additive.

Preferably, the parts by weight of said alkaline metal hydroxide are 200 parts by weight, the parts by weight of said weak acid salt are 50 parts by weight, and the parts by weight of said additive are 300 parts by weight.

Both of the alkaline metal hydroxide and the weak acid salt are materials which can be electrolyzed in water easily. The alkaline metal hydroxide and the weak acid salt, as the electrolytes, serve for electric conduction. The additive playing a role of anodic protection is adsorbed on the surface of the anode in the mixed solution, serves for inhibiting the dissolution of the anode, and at the same time, for sharpening. The reason is as follows. When the graphite gate electrode is placed into an electrolytic cell, it forms a circuit and produces an electric current. By the current, the anode loses electrons, which results in the dissolution phenomenon, so that the surface is continuously eroded. With the progressing of the dissolution, a thin film of oxides, which has high viscosity and high resistance, will appear on the surface of the anode. On the convex parts, the film is thinner, so that the resistance is smaller and thus the current density is larger than that on the concave parts. Thus, the convex parts are dissolved earlier, so that the roughness of the surface is reduced, and the purpose of polishing is achieved. The additive, such as glycerin, serves for corrosion inhibition. It can be adsorbed on the surface of the anode, and forms a stronger inhibition film and inhibits the dissolution of the anode to a certain extent. It allows the convex parts in the surface of the anode to be slowly dissolved, so as to make the polished surface even, shiny and fine, and thus serves for sharpening the surface of the workpiece to be polished.

After the alkaline metal hydroxide and the weak acid salt are dissolved in water, they exhibit a relatively strong ability to dissolve the anode. The graphite gate electrode obtained by electrochemically polishing a graphite gate electrode with the electrochemical polishing solution has a clean surface, which can improve the high-voltage-withstanding ability.

Preferably, said alkaline metal hydroxide is sodium hydroxide or potassium hydroxide; said weak acid salt is potassium hydrogen fluoride or potassium chromate; and said additive is glycerin. Glycerin serves for corrosion inhibition in the electrolyte solution, and can properly protect the graphite gate electrode used as anode.

Of course, said alkaline metal hydroxide and weak acid salt are not limited to the above-mentioned materials.

Preferably, according to some embodiments of the invention, the mixed solution has the following components of:

water: 900-1000 g;

sodium hydroxide or potassium hydroxide: 195-205 g;

potassium hydrogen fluoride or potassium chromate: 49-51 g; and glycerin: 294-306 g.

In 900-1000 g of water, when the content of glycerin is lower than 294 g, the polished surface is not sufficiently shiny; when the content is between 294 and 306 g, the polished surface is shiny and fine; and when the content is higher than 306 g, the foam in the solution is too much and affects the operation. Sodium hydroxide or potassium hydroxide can be decomposed into free metallic ions and hydroxyl ions. When sodium hydroxide or potassium hydroxide is less than 195 g, the hydroxyl ions would influence the pH value of the polishing solution. If the pH value is too low, the polishing speed is very slow. If sodium hydroxide or potassium hydroxide is more than 205 g, a too high pH value results in a stronger corrosion effect, and corrosion pits trend to be formed on the surface of the graphite gate. The aqueous solution of potassium hydrogen fluoride or potassium chromate can result in a lot of corrosive smoke. When potassium hydrogen fluoride is too much, for example, more than 51 g, too much hydrogen fluoride would generate in the solution, whereby the pH of the solution is decreased. Under heating condition, the elementary carbon in the graphite gate electrode can be oxidized by acid more easily, which trends to result in too fast dissolution, which makes the polished surface rough, and not very shiny and fine. If potassium hydrogen fluoride is too little, for example, less than 49 g, the impurities and burrs on the surface of the graphite gate cannot be removed completely.

Next, the process for polishing a graphite gate electrode with the electrochemical polishing solution provided by the invention will be described in details.

Referring to FIG. 1, the process for polishing the graphite gate electrode with the electrochemical polishing solution comprises the following steps of:

S11, placing an anode and a cathode into an electrochemical polishing solution, wherein a graphite gate electrode is used as the anode, and a conductive metal or alloy, such as a red copper sheet, is used as the cathode; and S12, providing an electric current to the anode and cathode to carry out the electrochemical polishing, wherein the electrochemical polishing solution is any one of the above-mentioned electrochemical polishing solutions provided by the invention.

Since the graphite gate electrode is made of pyrolytic graphite, the pyrolytic graphite is an ideal material for a gate electrode. However, in the production process of the pyrolytic graphite gate electrode, undesirable phenomena, such as burrs (that is, micro uneven parts), appear on the surface of the gate electrode. As the result of electrochemical dissolution, a viscose film forms on the surface of the graphite gate electrode of the invention. At the convex parts of the graphite gate electrode, the viscose film is thinner, and the current density is larger, so that the convex parts are more dissolved. At the concave parts, the viscose film is thicker, and the current density is larger, so that the convex parts are less dissolved. Thereby, the surface of the gate electrode becomes even.

The polishing solution of the invention is relatively stable. The graphite gate electrode obtained by polishing has a homogeneous and smooth surface, which has not burrs and has a good uniformity (that is, a good local evenness).

Pyrolytic graphite can be degassed below 900° C. and does not adsorb other gas any more. Therefore, the surface of the graphite gate electrode nearly does not release gas during exhausting gas at high temperature, so long as it is not contaminated. This process for polishing achieves the purpose of cleaning the surface of the graphite gate electrode, and thus increases the rate of finished products of electron tubes.

Furthermore, in order to increase the rate of the electrochemical polishing solution dissolving the graphite gate electrode, before placing an anode and a cathode into an electrochemical polishing solution, the process further comprises heating the electrochemical polishing solution to 90±5° C. A temperature of 90±5° C. can allow the alkaline metal hydroxide and the weak acid salt to react sufficiently, so that the alkaline metal hydroxide and the weak acid salt are sufficiently electrolyzed. Thereby, the electrolyte solution is improved in the conductivity and the ability of dissolving the anode.

In the specific embodiments, each of the polishing solutions prepared according to Example 1 to Example 3 and Comparative Example 1 to Comparative Example 4 shown in Table 1 is respectively placed in a ceramic barrel, which is not affected by chemical corrosion. The polishing solution is heated to 90° C.±5° C., for example, by an electric furnace. Preferably, an electric current of 160±5 amperes is provided to the anode and cathode for a duration of 3-5 min Tests on the uniformity and smoothness as well as the uniformity of the surface of the graphite gate electrode:

After the above-mentioned step S12 is performed, the polished graphite gate electrode is observed and touched with hand. According to visual sense and sense of touch, whether there are burrs on the surface of the graphite gate electrode and whether the surface is even (namely, locally even), are detected. In order to further verify the uniformity and smoothness as well as the uniformity of the surface of the graphite gate electrode, it is possible to observe the surface of the graphite gate electrode by an optical detector, such as a magnifying glass. By the observation, the uniformity and smoothness as well as the uniformity of the surface of the graphite gate electrode are determined on the basis of whether there are burrs on the surface, the degree of the existing of the burrs, whether a phenomenon of unevenness exists on the surface, etc.

By the above-mentioned verification method, the following results are achieved. Each of the surfaces of the graphite gate electrode polished by the polishing solutions of Example 1-Example 3 has not burrs, is relatively locally even on the whole, has better smoothness, and the local evenness is "good" or "excellent". In contrary, each of the surfaces of the graphite gate electrode polished by the polishing solutions of Comparative Example 1-Comparative Example 4 has burrs, is uneven everywhere, and the local evenness is "normal".

Table 1 is a table for comparing the polishing solutions provided by the invention and the polishing solutions provided by Comparative Examples, as well as showing the detection results obtained by polishing the graphite gate electrode with each polishing solution.

| | water | sodium hydroxide | potassium hydrogen fluoride | glycerin | evenness and smoothness | uniformity |
|---|---|---|---|---|---|---|
| Ex. 1 | 1000 g | 205 g | 51 g | 306 g | There is no burr on the surface | good |
| Ex. 2 | 950 g | 200 g | 50 g | 300 g | There is no burr on the surface | excellent |
| Ex. 3 | 900 g | 195 g | 49 g | 294 g | There is no burr on the surface | good |
| Com. Ex. 1 | 1000 g | 208 g | 51 g | 306 g | There are some burrs on the surface | normal |
| Com. Ex. 2 | 1000 g | 205 g | 53 g | 306 g | There are some burrs on the surface | normal |
| Com. Ex. 3 | 900 g | 190 g | 49 g | 294 g | There are some burrs on the surface | normal |
| Com. Ex. 4 | 900 g | 195 g | 47 g | 294 g | There are some burrs on the surface | normal |

Example 1

An anode and a cathode were placed into an electrochemical polishing solution having the composition described for Example 1 in Table 1 (water: 1000 g; sodium hydroxide: 205 g; potassium hydrogen fluoride: 51 g; and glycerin: 306 g), wherein a graphite gate electrode was used as the anode, and a red copper sheet was used as the cathode. An electric current of 160±5 amperes was provided to the anode and cathode, wherein the duration of providing electric current was 3-5 min and the temperature of the electrochemical polishing solution during the polishing was 90±5° C.

Concerning the polished graphite gate electrode, the surface of the graphite gate electrode was observed with eyes and touched with hand. As the result, there was no burr on the surface thereof and the surface was relatively even, which indicated that the uniformity was better. The corresponding uniformity level thereof was "good". Furthermore, the surface of the graphite gate electrode was observed by a magnifying glass. As the result, there was no burr on the surface thereof and the surface was relatively even. Throughout the surface of the graphite gate electrode, the number of uneven regions was very few. The phenomenon of unevenness was only slightly exhibited in certain regions. This result verified the result obtained by observation with eyes and touch with hand.

Example 2

An anode and a cathode were placed into an electrochemical polishing solution having the composition described for Example 2 in Table 1 (water: 950 g; sodium hydroxide: 200 g; potassium hydrogen fluoride: 50 g; and glycerin: 300 g), wherein a graphite gate electrode was used as the anode, and a red copper sheet was used as the cathode. An electric current of 160±5 amperes was provided to the anode and cathode, wherein the duration of providing electric current was 3-5 min and the temperature of the electrochemical polishing solution during the polishing was 90±5° C.

Concerning the polished graphite gate electrode, the surface of the graphite gate electrode was observed with eyes and touched with hand. As the result, there was no burr on the surface thereof and the surface was even. Additionally, the evenness of the surface was higher than that of the surface of the graphite gate electrode corresponding to Example 1. The corresponding uniformity level thereof was "excellent". Furthermore, the surface of the graphite gate electrode was observed by a magnifying glass. There was no burr on the surface thereof and the surface was very smooth. On the surface of the graphite gate electrode, there was almost no uneven region. This result verified the result obtained by observation with eyes and touch with hand.

Example 3

An anode and a cathode were placed into an electrochemical polishing solution having the composition described for Example 3 in Table 1 (water: 900 g; sodium hydroxide: 195 g; potassium hydrogen fluoride: 49 g; and glycerin: 294 g), wherein a graphite gate electrode was used as the anode, and a red copper sheet was used as the cathode. An electric current of 160±5 amperes was provided to the anode and cathode, wherein the duration of providing electric current was 3-5 min and the temperature of the electrochemical polishing solution during the polishing was 90±5° C.

The graphite gate electrode polished with this polishing solution exhibited a surface finish and a uniformity similar to those of the structure obtained in Example 1. Concerning the polished graphite gate electrode, the surface of the graphite gate electrode was observed with eyes and touched with hand. As the result, there was no burr on the surface thereof and the surface was relatively even, which indicated that the uniformity was better. The corresponding uniformity level thereof was "good". Furthermore, the surface of the graphite gate electrode was observed by a magnifying glass. As the result, there was no burr on the surface thereof and the surface was relatively even. Throughout the surface of the graphite gate electrode, the number of uneven regions was very few. The phenomenon of unevenness was only slightly exhibited in certain regions. This result verified the result obtained by observation with eyes and touch with hand.

Comparative Example 1

An anode and a cathode were placed into an electrochemical polishing solution having the composition described for Comparative Example 1 in Table 1 (water: 1000 g; sodium hydroxide: 208 g; potassium hydrogen fluoride: 51 g; and glycerin: 306 g), wherein a graphite gate electrode was used as the anode, and a red copper sheet was used as the cathode. An electric current of 160±5 amperes was provided to the anode and cathode, wherein the duration of providing electric current was 3-5 min and the temperature of the electrochemical polishing solution during the polishing was 90±5° C.

Compared with the polishing solution of Example 1 in each and every component, this solution had a higher content of sodium hydroxide. The surface of the graphite gate electrode was observed with eyes and touched with hand. As the result, there were some protrusions and pits, and furthermore, a few relatively sharp burrs. The surface was not very even. This indicated that the uniformity was normal or inferior. The corresponding uniformity level thereof was "normal". The reason was as follows. As the content of sodium hydroxide or potassium hydroxide was higher than 205 g, the pH of the solution was too high, so as to result in a stronger corrosion effect in the solution. At this time, corrosion pits (that is, pits) trended to appear on the surface of the graphite gate. The regions other than the pits were protrusions. The protrusions were different in area and height. Smaller and higher protrusions could be regarded as relatively apparent burrs.

Comparative Example 2

An anode and a cathode were placed into an electrochemical polishing solution having the composition described for Comparative Example 2 in Table 1 (water: 1000 g; sodium hydroxide: 205 g; potassium hydrogen fluoride: 53 g; and glycerin: 306 g), wherein a graphite gate electrode was used as the anode, and a red copper sheet was used as the cathode. An electric current of 160±5 amperes was provided to the anode and cathode, wherein the duration of providing electric current was 3-5 min and the temperature of the electrochemical polishing solution during the polishing was 90±5° C.

Compared with the polishing solution of Example 1 in each and every component, this solution had a higher content of potassium hydrogen fluoride. The surface of the graphite gate electrode was observed with eyes and touched with hand. As the result, there were a few burrs, and the surface was relatively rough and not very shiny and fine. This indicated that the uniformity was normal or inferior. The corresponding uniformity level thereof was "normal". The reason was as follows. The aqueous solution of potassium hydrogen fluoride or potassium chromate can result in a lot of corrosive smoke. When potassium hydrogen fluoride is too much, for example, more than 51 g, too much hydrogen fluoride would generate in the solution, whereby the pH of the solution was decreased. Under heating condition, the elementary carbon in the graphite gate electrode can be oxidized by acid more easily, which trended to result in too fast dissolution, which made the polished surface rough, and not very shiny and fine.

Comparative Example 3 and Comparative Example 4

An anode and a cathode were placed into electrochemical polishing solutions having the compositions described for Comparative Examples 3 and 4 in Table 1 (in Comparative Example 3, water: 900 g; sodium hydroxide: 190 g; potassium hydrogen fluoride: 49 g; glycerin: 294 g; and in Comparative Example 4, water: 900 g; sodium hydroxide: 195 g; potassium hydrogen fluoride: 47 g; and glycerin: 294 g), respectively, wherein a graphite gate electrode was used as the anode, and a red copper sheet was used as the cathode. An electric current of 160±5 amperes was provided to the anode and cathode, wherein the duration of providing electric current was 3-5 min and the temperature of the electrochemical polishing solution during the polishing was 90±5° C.

Compared with Example 3, the content of sodium hydroxide and the content of potassium hydrogen fluoride in a solution were decreased in Comparative Example 3 and Comparative Example 4, respectively. The surfaces of the graphite gate electrodes obtained in Comparative Example 3 and Comparative Example 4 were observed with eyes and touched with hand one after another. According to the detection results of Comparative Example 3, compared with that of Example 3, the speed of polishing was slower. The burrs on the surface of the graphite gate electrode obtained in the predetermined period were not completely cleaned up, and the surface was not very even. The uniformity level thereof was "normal". As comparing the detection result of Comparative Example 4 with that of Example 3, the burrs on the surface of the graphite gate electrode were not completely cleaned up, and the surface was not very even. The uniformity level thereof was "normal". This further verified that if the content of potassium hydrogen fluoride was too low, for example, less than 49 g, the impurities and burrs on the surface of a graphite gate electrode cannot be completely removed.

From the above results of experiments and analysis, it can be known that the results of experiments of Example 1-Example 3 are better. The surfaces of the resultant graphite gate electrodes are homogeneous and shiny, and have good uniformity. The results of experiments of Comparative Example 1-Comparative Example 4 are worse. The surfaces of the resultant graphite gate electrodes have burrs and normal or inferior uniformity. It can be seen that the following proportion of the components of the polishing solution of the invention is preferred: water: 900-1000 g; sodium hydroxide or potassium hydroxide: 195-205 g; potassium hydrogen fluoride or potassium chromate: 49-51 g; and glycerin: 294-306 g. That is, in the polishing solution, 900-1000 parts by weight of water, 195-205 parts by weight of an alkaline metal hydroxide, 49-51 parts by weight of a weak acid salt and 294-306 parts by weight of an additive can solve the following problem in prior art: the dusts and burrs on the surface of the graphite gate electrode cannot be removed. The polishing solution provided by the invention is an electrochemical polishing solution. The surface of the graphite gate electrode obtained by polishing has improved smoothness.

In duration of providing current of 3-5 min, the invention can clean up the burrs on the surface of the graphite gate electrode, so as to make the surface of the graphite gate electrode smooth and even. In prior art, the surface of the graphite gate electrode is immersed into gasoline for 12 h, but the impurities thereon cannot be cleaned up. In contrast, the invention greatly reduces the duration for treating the graphite gate electrode, and improves the evenness of the treated surface of the gate electrode, so as to avoid the problem that the transistor becomes failure due to the too large current at the burrs on the surface of the gate electrode. Furthermore, in the polishing solution provided according to the invention, neither the solute nor the solvent comprises a flammable ingredient. It has higher safety than the prior art, in which gasoline is used for cleaning.

The principle of the above-mentioned polishing process is as follows.

Hydroxyl groups lose electrons at the anode and change to oxygen gas. Hydrogen ions from the ionization of water obtain electrons at the cathode and change to hydrogen gas. The electrode reaction formulas are as follows respectively:

$$2H^{+}+2e=H_2\uparrow,$$

$$4OH^{-}-4e=2H_2O+O_2\uparrow$$

When coming into contact with water, potassium hydrogen fluoride trends to decompose and release hydrogen fluoride gas. When hydrogen fluoride gas is dissolved in water, hydrofluoric acid will be produced. Potassium fluoride will lose fluorine ion in the presence of hydrofluoric acid, and form $HF_2^{-}$;

$$KHF_2^{+}=HF+KF;$$

$$KF=K^{+}+F^{-};$$

$$HF+F^{-}=HF_2^{-};$$

On the surface of a fresh pyrolytic graphite gate electrode, some impurities generated from the production process will remain. Such impurities need to be removed by electrochemical polishing. Sodium hydroxide in the electrolyte solution will decompose into a free sodium ion and a free hydroxyl ion in water. The free sodium and the $[SiO_3^{2-}]$, $[Al^{3+}]$ ions, which derives from the decomposition of the impurities on the surface, are combined, so as to produce insoluble $Na_2SiF_6$ and an insoluble salt, cryolite, which is similar to sodium fluorosilicate. The reaction formulas are as follows.

$$NaOH=Na^{+}+OH^{-};$$

$$2Na^{+}+SiO_3^{2-}+6HF^{2-}=Na_2SiF_6\downarrow+3H_2O+6F^{-};$$

$$3Na^{+}+Al^{3+}+3HF^{2-}=Na_3AlF_6\downarrow+3H^{+};$$

Further, in order to make the surface of the graphite gate electrode cleaner, the process further comprises the following steps.

Firstly, the electrochemically polished graphite gate electrode is washed with water. In this step, ions of the electrolyte within the electrochemical polishing solution on the surface of graphite gate electrode can be washed off.

Then, the graphite gate electrode washed with water is cleaned in an ultrasonic cleaning device for 50-60 min. In this step, the ions on the surface of the graphite gate electrode are further cleaned up.

In prior art, after the impurities and burrs are removed by gasoline, it is difficult to wash the gasoline off. In contrast, the invention uses ultrasonic treatment to clean the electrochemical polishing solution on the surface of the graphite gate electrode. It can completely clean up the ions in the solution. As a result, there are neither burrs nor other impurities on the surface of the graphite gate electrode; the current at the burrs of the graphite gate electrode is avoided; at the same time, the problem that the graphite gate electrode is contaminated is also avoided; and the surface of the graphite gate electrode nearly does not release gas during exhausting gas at high temperature, so long as it is not contaminated. Thus, the rate of finished products of electron tubes is increased.

Next, the graphite gate electrode cleaned with the ultrasonic cleaning device is subjected to dewatering treatment. Subjecting the graphite gate electrode to dewatering treatment comprises the step of cleaning the graphite gate electrode cleaned by the ultrasonic cleaning device with an alcohol, so as to clean up water molecules on the surface of the graphite gate electrode.

Further, the following step also can be included: blow-drying the dewatered graphite gate electrode by high pressure air or a hair drier, in order to ensure complete removal of the water molecules from the surface of the graphite gate electrode.

In the invention, by means of the dewatering treatment process, the problem that the graphite gate electrode is contaminated is further avoided.

From the above-mentioned process it can be known that in the electrochemical polishing treatment on the graphite gate electrode according to the invention, by electrochemically treating the burrs for about 3-5 min, certain evenness and smoothness of the surface of the graphite gate electrode can be achieved. The electrolyte on the surface of the gate electrode is washed for about 1 h. After washing, the surface of the gate electrode can achieve certain cleanliness.

By adopting electrochemical polishing solution provided by the invention to polish the graphite gate electrode, not only the purpose of treating the graphite gate electrode in short time is achieved, but also the surface of the graphite gate electrode obtained by polishing becomes homogeneous and shiny, and has good uniformity. Additionally, in the process of the surface treatment for the graphite gate electrode, the adopted facilities are simple; the process is simple; the pollution to environment is small; the utilization rate of the solution is high; the operation is safe; the surface of the treated gate electrode is shiny and even, which is advantageous to reduce the current at the burrs of the gate electrode. It facilitates to improve the uniformity of the parameters of the electron tube and reduce costs. It meets the demand in quality of the electron tube, and reduces the production costs of the electron tube.

It is apparent that those skilled in the art can make various changes and modifications without departing the spirit and scope of the invention. Thus, if such changes and modifications fall within the range of the claims of the invention and equivalents of the same, the invention intends to include these changes and modifications.

What is claimed is:

1. A process for electrochemically polishing a graphite gate electrode, comprising the steps of:

placing an anode and a cathode into an electrochemical polishing solution and providing an electric current to the anode and the cathode to carry out the electrochemical polishing, wherein a graphite gate electrode is used as the anode, and a conductive metal or an alloy electrode is used as the cathode, and the electrochemical polishing solution comprises:

900-1000 parts by weight of water;

195-205 parts by weight of an alkaline metal hydroxide;

49-51 parts by weight of a weak acid salt; and 294-306 parts by weight of an additive for inhibiting the dissolution of the anode.

2. The process according to claim 1, wherein providing the electric current to the anode and cathode to carry out the electrochemical polishing comprises providing an electric current of 160±5 amperes to the anode and cathode, wherein the duration of providing the electric current is 3-5 min and the temperature of the electrochemical polishing solution during the polishing is 90±5° C.

3. The process according to claim 1, further comprising the steps of:

washing the electrochemically polished graphite gate electrode with water;

cleaning the graphite gate electrode washed with water in an ultrasonic cleaning device for 50-60 min; and subjecting the graphite gate electrode cleaned by the ultrasonic cleaning device to dewatering treatment.

4. The process according to claim 3, wherein subjecting the graphite gate electrode to dewatering treatment comprises cleaning the graphite gate electrode cleaned by the ultrasonic cleaning device with an alcohol.

5. The process according to claim 4, wherein subjecting the graphite gate electrode to dewatering treatment further comprises blow-drying the graphite gate electrode cleaned with an alcohol by high pressure air or a hair drier.

6. The process according to claim 1, wherein the parts by weight of the alkaline metal hydroxide are 200 parts by weight, the parts by weight of the weak acid salt are 50 parts by weight, and the parts by weight of the additive for inhibiting the dissolution of the anode are 300 parts by weight.

7. The process according to claim 1, wherein the alkaline metal hydroxide is a sodium hydroxide or potassium hydroxide.

8. The process according to claim 1, wherein the weak acid salt is potassium hydrogen fluoride or potassium chromate.

9. The process according to claim 1, wherein the additive is glycerine.

* * * * *